United States Patent [19]

Kennedy

[11] Patent Number: 4,589,693

[45] Date of Patent: May 20, 1986

[54] REUSABLE LOCKING DEVICE

[76] Inventor: Thomas D. Kennedy, 7108 Blue Beach, Fort Wayne, Ind. 46815

[21] Appl. No.: 530,205

[22] Filed: Sep. 8, 1982

[51] Int. Cl.[4] ..... B65D 33/34

[52] U.S. Cl. ..... 292/315

[58] Field of Search ..... 292/315, 320, 317, 307, 292/251; 70/39, DIG. 81

[56] References Cited

U.S. PATENT DOCUMENTS

| | | | |
|---|---|---|---|
| Re. 6,730 | 11/1875 | Cummings | 411/403 |
| 1,042,508 | 10/1912 | Waing | 70/DIG. 81 |
| 1,305,959 | 6/1919 | Billings | 70/DIG. 81 X |
| 1,809,804 | 6/1931 | Rider | 70/DIG. 81 |
| 1,902,665 | 3/1933 | Reinhold | 70/39 |
| 1,911,060 | 5/1933 | Clark | 292/307 R |
| 2,222,667 | 11/1940 | Kitzelman | 292/251 X |
| 2,729,231 | 1/1956 | Quest | 292/251 X |
| 3,330,586 | 7/1967 | Becker | 292/315 |
| 3,613,410 | 10/1971 | Shaw | 70/DIG. 81 |
| 4,061,370 | 12/1977 | Hauber | 70/DIG. 81 |
| 4,084,417 | 4/1978 | Daniel | 70/431 |
| 4,170,120 | 10/1979 | Feltman | 70/DIG. 81 |

FOREIGN PATENT DOCUMENTS

| | | | |
|---|---|---|---|
| 539443 | 11/1931 | Fed. Rep. of Germany | 70/DIG. 81 |

*Primary Examiner*—Richard E. Moore

*Attorney, Agent, or Firm*—Albert L. Jeffers; Anthony Niewyk

[57] ABSTRACT

A reusable tamperproof lock having a body and shackle which as tow parallel ends disposed in a first aperture in the body. A locking screw is threadly engaged in a second aperture in the body for locking engagement with complimentary portions of the shackle ends. The locking screw is removable by means of a non-standard tool such as a pentagonal driver. The head of the locking screw is concealed by a deformable plastic cap. A simulated key hole is provided in the lock body.

11 Claims, 7 Drawing Figures

REUSABLE LOCKING DEVICE

BACKGROUND OF THE INVENTION

1. Field of the Invention

This invention relates generally to tamper proof mechanical locking devices, and more particularly to a tamper proof reusable locking device for securing hasp-type closures.

2. Description of the Prior Art

Tamper proof mechanical locking devices conventionally comprise a mechanism having the semblance of a lock providing a key hole. Typically, such prior simulated locks do not accommodate keys, do not function as key-type locks and are operable by inserting a rodlike instrument into the assembly.

Tamper proof mechanical locking devices are also known to conceal the locking member in the guise of an assembly screw. Alternatively, such prior tamper proof mechanical locking devices modify the locking member to include a screw head configuration requiring a corresponding tool. Other prior tamper proof locking devices are known to combine a spring latch with a dead bolt, both operable by the same key in a specific predetermined sequence.

SUMMARY OF THE INVENTION

The invention in its broader aspects embodies a reusable locking device for securing or sealing hasp-type closures. The device consists of a body having an aperture on one surface, and a shackle having a loop portion with opposite ends insertable into the aperture. The body has an adjacent surface having a counterbore with a tapped hole therein. A screw has a head seated in the counterbore and an end threaded through the hole to engage the shackle ends at an angular communication of the aperture and hole within the body. In accordance with the invention, means for preventing tampering is provided in the screw head including a recessed driver-receiver portion having a non-standard configuration, and a cap plug suggesting the appearance of a rivet head to conceal the countersunk screw head in the hole. Means for detecting tampering is provided by one or more of the following: providing such a tight press fit between the plug and the counterbore that removal of the plug requires partial mutilation of the fragile plug flange; sealing the cap with a drop of colored adhesive; placing a plastic insert between the shackle ends engaged within the aperture; or encasing the shackle ends in thermo-labile tubing.

In the preferred embodiment of the invention, the tamper-proof means is a countersunk screw head having a non-standard pentagonal recess for receiving a complementary non-standard driver.

It is an object of the invention to provide an improved tamper-proof reusable mechanical locking device.

Another object of the invention is to provide an improved tamper proof reusable mechanical locking device including means for detecting tampering.

The above mentioned and other features and objects of this invention and the manner of attaining them will become more apparent and the invention itself will be best understood by reference to the following description of embodiments of the invention taken in conjunction with the accompanying drawings.

DESCRIPTION OF THE PREFERRED EMBODIMENT

Figure 1:
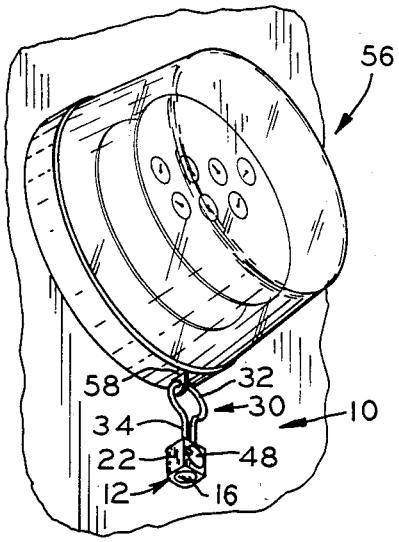
FIG. 1 is a perspective view of the improved reusable mechanical locking device of the invention securing a hasp-type closure.
Figure 2:
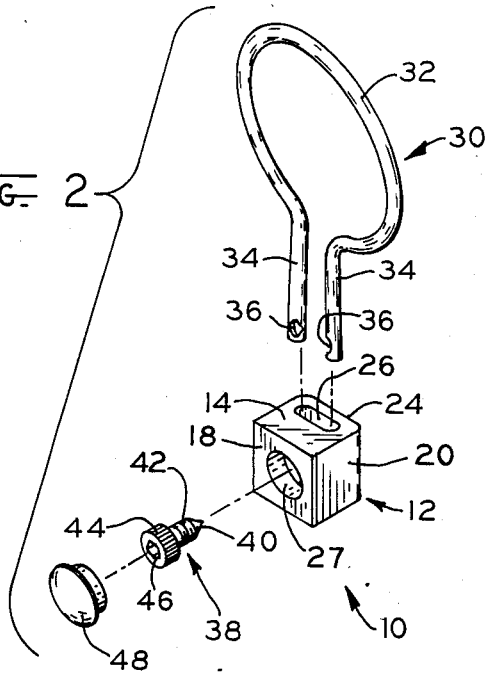
FIG. 2 is an exploded view of the locking device showing the component parts of the invention: the body, the shackle, the screw and the cap plug.
Figure 3:
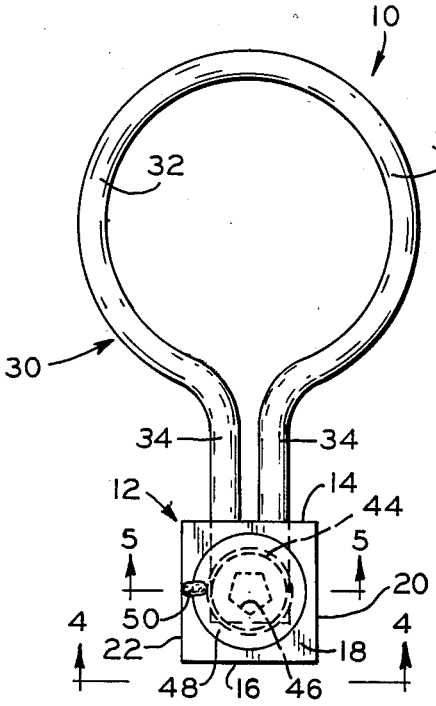
FIG. 3 is a front elevational view of the assembled locking device showing the shackle ends inserted in the aperture and the screw inserted in the tapped hole.
Figure 5:
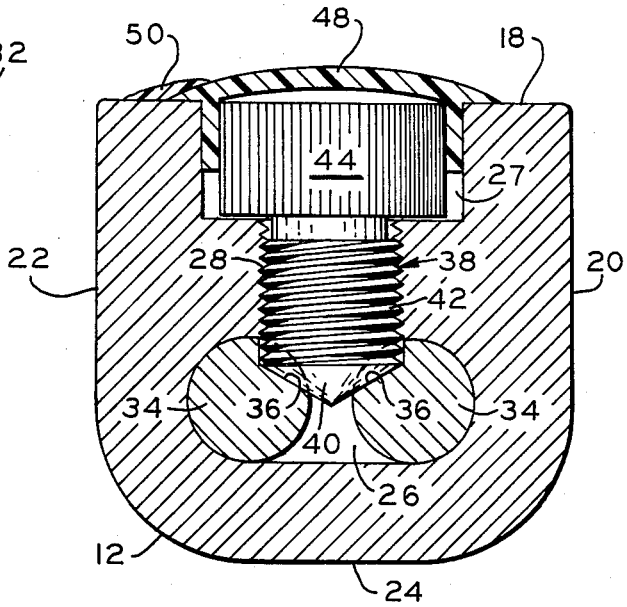
FIG. 5 is a cross-sectional view of the assembled locking device, taken generally along the line 5—5 of FIG. 3.
Figure 4:
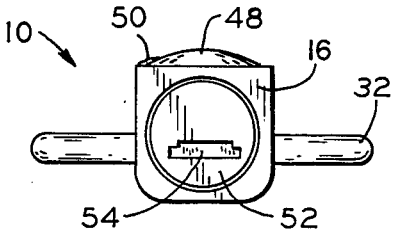
FIG. 4 is a bottom plan view of the assembled locking device taken generally along the line 4—4 of FIG. 3.

Referring now to FIGS. 1, 2, 3 and 5 of the drawings, there is shown the reusable locking device 10 of the invention formed of any suitable corrosion resistant material such as sintered ferrous metal, sintered non-ferrous metal, stainless steel, or molded or extruded plastic. Locking device 10 has body 12 formed of sintered metal with top and bottom walls 14, 16, side walls 20, 22, front wall 18 and back wall 24. Top wall 14 has an aperture 26 therein, and front wall 18 has counterbore 27 with tapped hole 28 therein. Aperture 26 and hole 28 communicate within body 12, preferably at a 90° angle, as shown in FIG. 5.

Screw 38 formed of suitable corrosion resistant material such as stainless steel, having threads 42 and conical end 40 is threaded into tapped hole 28 to countersink screw head 44 in counterbore 27 of front wall 18 with conical end 40 extending into aperture 26. Shackle 30 formed of suitable metal spring wire, preferably stainless steel, comprises loop portion 32 and opposite adjacent ends 34 each having a circular cross section and complementary indentations 36. Shackle ends 34 are insertable into aperture 26.

Conical screw end 40 threaded through tapped hole 28 to engage complementary indentations 36 in shackle ends 34 in aperture 26 forms a positive engagement between shackle ends 34 and conical screw end 40 to secure shackle 30 to body 12.

Screw head 44 has recessed pentagonal driver-receiver 46 having five equal length flats spaced around a circle which requires a complementary, non-standard pentagonal driver. The requirement of a complementary pentagonal driver provides means for preventing tampering. Cap plug 48, suggesting the appearance of a rivet head, preferably formed of metal-colored molded plastic, press fits into counterbore 27 and obscures the existence of screw 38 to provide further means for preventing tampering. Drop 50 of colored adhesive paint may form a seal which must be visibly broken in order to remove cap 48 and also provides means for detecting tampering.

Simulated lock cylinder 52 and simulated key slot 54 may be provided on end 16 of body 12 as a further means for preventing tampering. Tampering is prevented by creating the illusion by means of simulated key slot 54 that a special key is required to operate the simulated lock cylinder 52, thus discouraging tampering by unauthorized individuals. Further, in the event that an unauthorized person does have a key which fits into simulated key hole 52, tampering is still prevented since the key will not operate the lock because as described above, shackle 30 may be released from body 12 only by removal of screw 38 from hole 28.

Figure 6:
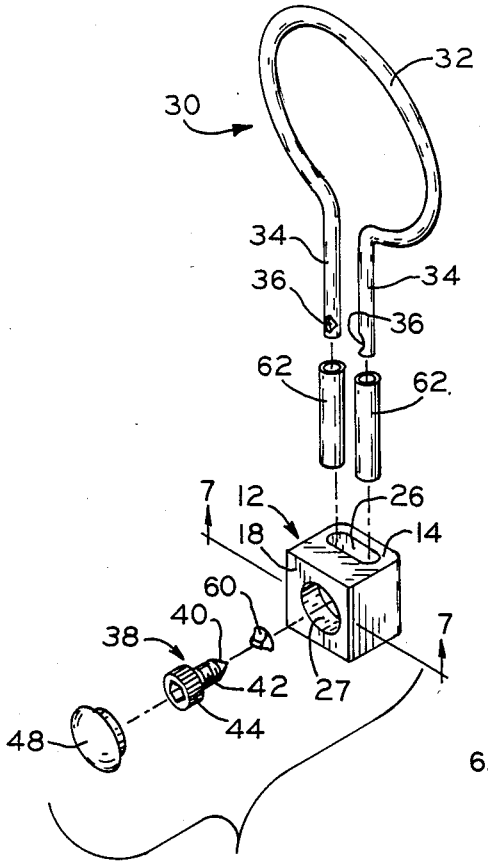
FIG. 6 is an exploded view of the locking device showing the component parts of another embodiment of the invention: the body, the shackle, the screw, the cap plug, the plastic insert and the thermo-labile tubing.
Figure 7:
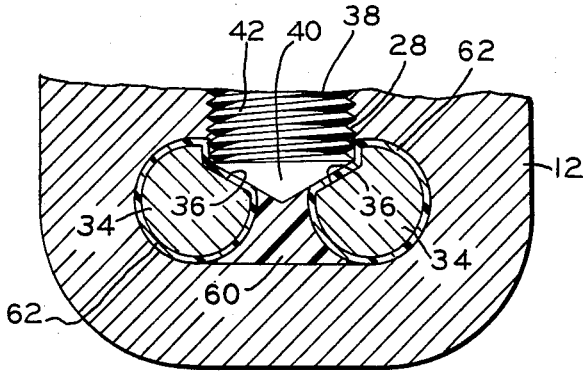
FIG. 7 is a partial cross-sectional view of the assembled locking device of FIG. 6, taken along line 7—7 showing the conical screw end engaging the tube-encased shackle ends.

Another means for detecting tampering may be provided by placing plastic insert 60 between shackle ends 34 engaged by screw 38, as shown in FIG. 6. Encasing shackle ends 34 in thermo-labile tubing 62 when engaged by screw 38 will also provide additional means for detecting tampering, as shown in FIG. 7.

It will now be seen that the invention provides a tamper-proof, reusable locking device for hasp-type closures, such as utility meter 56 having hasp-type closure 58. Removal of screw 38 from hole 28 by use of the complementary driver, releases shackle 30 from body 12. The locking device of the invention may be used again simply by using shackle 30 to engage another, or the same hasp-type closure, and repeating the steps of inserting shackle ends 34 into aperture 26 of body 12 and engaging thereof with screw 38, as above-described. Plastic cap plug 48 covers countersunk screw head 44 in wall 18, and another drop 50 of colored adhesive paint is placed over cap 48.

The reusable locking device of the invention is tamper-proof by reason of cap plug 48, appearing as a rivet head to camouflage screw 38, and screw head 44 having a non-standard pentagonal recessed driver-receiver 46 requiring a complementary, non-standard pentagonal driver. Other screws may be used wherein the heads have other non-standard recessed driver-receivers requiring complementary, non-standard drivers other than non-standard pentagonal drivers.

There is described above a preferred embodiment of the invention, however, it will be understood that the invention lends itself to further modification. Variations may be made within the scope of this invention, and also changes or adaptations to details of construction may be made including such departures from the present disclosure as come within known or customary practice in the art to which this invention pertains and fall within the scope of the appended claims.

What is claimed is:

1. A reusable tamper proof locking device comprising:

a body including a first hole and an aperture therein, said hole and aperture intersecting within said body;

a shackle having a loop portion and two substantially parallel ends, said ends each including an indentation therein, said ends including said indentations received in said aperture;

locking means including an engaging portion disposed in said hole, said engaging portions being complimentary and lockably engaged with said indentations whereby said ends are restrained from axial movement in said aperture;

said locking means further including means for disengaging said engaging portion from said indentations thereby enabling removal of said shackle ends from said aperture;

said body further including a simulated lock cylinder and key slot; and means for concealing said disengaging means and comprising a second hole for receiving said disengaging means and a cap for covering said second hole.

2. The locking device of claim 1 wherein said cap comprises a molded plastic plug tightly secured in said second hole whereby said cap is mutilated upon removal from said second hole.

3. The locking device of claim 1 wherein said cap is of the same color as said body.

4. The locking device of claim 1 and including a drop of colored adhesive paint in contact with both said cap and with said body.

5. The locking device of claim 1 wherein said body is comprised of sintered metal.

6. The locking device of claim 1 wherein said shackle is made of stainless steel wire.

7. The locking device of claim 1 wherein said first hole is threaded and wherein said engaging portion is a threaded screw having a conical end to engage said shackle end complimentary indentations, said disengaging means comprising a nonstandard screw head.

8. The locking device of claim 7 wherein said nonstandard screw head consists of a recessed pentagonal driver receiver.

9. The locking device of claim 1 wherein said engaging portion is made of stainless steel.

10. A reusable tamper proof and tamper ascertainable locking device comprising:

a body including a plurality of external surfaces;

an aperture in a first surface, a threaded hole in a second surface oriented substantially perpendicularly to said aperture;

a shackle having a loop portion and two substantially parallel ends, each said end including an indentation therein, said indentations being in opposed and facing relationship, said shackle ends including said indentations axially slidably received in said aperture;

a threaded screw disposed in said hole, said screw including a screw head having a pentagonal aperture therein, said screw head received in an enlarged portion of said hole, said screw further including a conical end opposite said screw head, said conical end complimentary with and engaged with said indentations thereby preventing axial movement of said shackle ends with respect to said body;

a plastic cap plug covering said hole and screw head, said cap plug being metal colored; and a simulated lock cylinder and key slot in said body.

11. The device of claim 10 wherein said body is made of sintered metal, said shackle is made of stainless steel wire and wherein said screw is made of stainless steel.

* * * * *